US007747431B2

(12) United States Patent
Murashima

(10) Patent No.: US 7,747,431 B2
(45) Date of Patent: Jun. 29, 2010

(54) CODE CONVERSION METHOD AND DEVICE, PROGRAM, AND RECORDING MEDIUM

(75) Inventor: Atsushi Murashima, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 10/553,700

(22) PCT Filed: Apr. 22, 2004

(86) PCT No.: PCT/JP2004/005802

§ 371 (c)(1),
(2), (4) Date: Oct. 17, 2005

(87) PCT Pub. No.: WO2004/009524

PCT Pub. Date: Nov. 4, 2004

(65) Prior Publication Data

US 2006/0224389 A1 Oct. 5, 2006

(30) Foreign Application Priority Data

Apr. 22, 2003 (JP) ..... 2003-117421

(51) Int. Cl.
*G10L 21/00* (2006.01)

(52) U.S. Cl. ..... 704/221; 704/500

(58) Field of Classification Search ..... 704/221, 704/500

See application file for complete search history.

(56) References Cited

U.S. PATENT DOCUMENTS 5,694,425 A * 12/1997 Suganuma et al. ..... 375/240
5,768,281 A * 6/1998 Takano ..... 370/503
5,995,923 A * 11/1999 Mermelstein et al. ..... 704/219
6,044,070 A * 3/2000 Valentine et al. ..... 370/316
6,658,064 B1 * 12/2003 Rotola-Pukkila et al. .... 375/295
6,678,654 B2 * 1/2004 Zinser et al. ..... 704/221
6,718,298 B1 * 4/2004 Judge ..... 704/215
7,016,831 B2 * 3/2006 Suzuki et al. ..... 704/203
7,222,069 B2 * 5/2007 Suzuki et al. ..... 704/201
2003/0065508 A1 4/2003 Tsuchinaga et al.

(Continued)

FOREIGN PATENT DOCUMENTS

EP 1 288 913 A2 3/2003

(Continued)

OTHER PUBLICATIONS

Manfred R. Schroeder, et al, "Code-Excited Linear Prediction (CELP); High-Quality Speech At Very Low Bit Rates," IEEE, 1985, pp. 937-940.

(Continued)

*Primary Examiner*—Daniel D Abebe
(74) *Attorney, Agent, or Firm*—Dickstein Shapiro LLP

(57) ABSTRACT

An audio decoding device (1) generates a first decoded audio from a first code string by a first decoding method, AN audio encoding device (2) judges whether the first decoded audio is an audio signal or a non-audio signal by using the information contained in the first code string and generates a second code string by encoding the first decoded audio by the second encoding method according to the judgment. Thus, there are provided a device and a method for converting a code obtained y encoding audio by a certain method into a code decodable by the other method with a low calculation amount.

12 Claims, 4 Drawing Sheets

U.S. PATENT DOCUMENTS

| | | | | |
|---|---|---|---|---|
| 2004/0213296 | A1* | 10/2004 | Kanayama et al. | 370/535 |
| 2005/0159943 | A1* | 7/2005 | Zinser et al. | 704/219 |

FOREIGN PATENT DOCUMENTS

| | | | |
|---|---|---|---|
| JP | 61-180299 | | 8/1986 |
| JP | 8-146997 | | 6/1996 |
| JP | 8-279811 | A | 10/1996 |
| JP | 10-11100 | | 1/1998 |
| JP | 2000-078274 | A | 3/2000 |
| JP | 2001-53869 | | 2/2001 |
| JP | 2002-041091 | A | 2/2002 |
| JP | 2002-149196 | | 5/2002 |
| JP | 2002-202799 | | 7/2002 |
| JP | 2003-76394 | | 3/2003 |
| WO | WO 01/08136 | A1 | 2/2001 |

OTHER PUBLICATIONS

Abbreviations and Outline description table, Dec. 1999, pp. 13-20.
Scope, Normative References and Technical Description of VAD Option 1, 1999, pp. 5-20.
Definitions and Abbreviations, AMR codec frame format, Release 1999, pp. 5-19.
Scope, Normative references, Definitions, symbols and abbreviations, 1999, pp. 5-12.
Lee et al., "A Novel Transcoding Algorithm for AMR and EVRC Speech Codecs Via Direct Parameter Transformation", 2003 IEEE International Conference on Acoustics, Speech, and Signal Processing Proceedings (ICASSP), vol. 1 of 6, pp. 177-180 (New York and Hong Kong) (2003).

* cited by examiner

CODE CONVERSION METHOD AND DEVICE, PROGRAM, AND RECORDING MEDIUM

TECHNICAL FIELD

The present invention relates to a method of encoding and decoding an audio signal at a low bit rate to transmit or storing the same, and more particularly, to a code conversion method and device, a program and a recording medium all of which are used for converting a code obtained by encoding an audio by a certain method, into another code that is decodable by any other method.

BACKGROUND ART

As a method of encoding an audio signal at a middle or a low bit rate in high efficiency, a method has been widely used which encodes the audio signal by separating it into a linear prediction (LP) filter and an excitation signal to drive the filter. As such a representative method, there is known Code Excited Linear Prediction (CELP) (e.g., see Nonpatent Document 1; M. R. Schroeder and B. S. Atal: "Code excited linear prediction: High quality speech at very low bit rates," Proc. of IEEE Int. Conf. on Acoust., Speech and Signal Processing, pp. 937-940, 1985).

The CELP is a method of obtaining a synthesized audio signal by driving an LP filter provided with an LP coefficient indicative of frequency characteristics of an input audio, by an excitation signal represented by a sum of an adaptive codebook (ACB) indicative of a pitch cycle of the input audio and a fixed codebook (FVB) composed of a random number or a pulse. The ACB and FCB components are multiplied by gains (ACB and FCB gains), respectively.

For example, assuming a mutual connection between a 3G mobile network and a cable packet network, it is to be noted that standard audio encoding methods used for both of the networks are different from each other and this brings about a problem of difficulty of a direct connection to occur between the 3G mobile network and the cable packet network difficult. As a solution to this problem, a tandem connection has been developed.

Now, referring to FIG. 5, there is shown an example of a configuration of a code conversion device for converting a code (first code string or sequence) obtained by encoding an audio by using a first audio encoding method (method 1) into a code (second code string or sequence) decodable by a second method (method 2). The conventional code conversion device based on the tandem connection will be described more specifically by referring to FIG. 5. Audio encoding and decoding methods are disclosed in the Nonpatent Document 1 or 3GPP Specification (3rd generation Party: Technical Specification) or the like (Nonpatent Document 2: "AMR speech code; Transcoding functions" 3GPP TS 26.090 Chapter 4). Description will be made on the presumption that a code string is input/output at a frame period (e.g., period of 20 milliseconds) which is a processing unit of audio encoding/decoding.

An audio decoding device 1A shown in FIG. 5 is operated to decode an audio signal or a non-audio signal, such as noise, in response to a first code string input through an input terminal 3 by a first decoding method corresponding to a first encoding method, and to output the decoded signal as a first decoded signal to both an audio encoding device 2A and an audio detection device 5.

The audio detection device 5 receives the first decoded signal output from the audio decoding device 1A, judges whether the first decoded signal specifies an audio section or a non-audio section, and outputs an audio detection result flag to the audio encoding device 2A on the basis of a result of the judgment. An audio detection method is described in detail in the 3GPP Specification or the like. Thus, it is not described in detail here (Nonpatent Document 3 "AMR speech code; Voice Activity Detector (VAD)" 3GPP TS 26.094 Chapter 3).

The audio encoding device 2A is operable in response to the first decoded signal output from the audio decoding device 1A and the audio detection result flag output from the audio detection device 5. From the audio detection result flag, judgment can be made as to whether the first decoded signal specifies an audio section or a non-audio section. Responsive to the audio detection result flag, the audio encoding device 2A outputs a code string obtained by encoding an audio signal or a non-audio signal by a second encoding method to produce a second code string through an output terminal 4. The description of FIG. 5 has been completed so far.

Details on header and frame type information input to the audio decoding device 1A have been known (Nonpatent Document 4: "AMR speech codec; frame structure" 3GPP TS 26.101 Chapter 4). Additionally, methods described below for encoding and decoding noise have been known (Nonpatent Document 5: "AMR speech codec; comfort noise aspects" 3GPP TS 26.092 Chapters 5 and 6).

As mentioned above, the aforementioned conventional code conversion device uses the audio detection device to judge whether the signal decoded from the first code string specifies the audio section or the non-audio section. Therefore, such inclusion of the audio detection device causes a problem to occur in that the code conversion device inevitably becomes large in size. In other words, the Nonpatent Documents 1 to 5 have no mention at all of a possibility of improvement of the code conversion device shown in FIG. 5.

DISCLOSURE OF THE INVENTION

The present invention has been developed in considering the foregoing problems in mind, and its primary object is to provide a device and a method for converting codes, wherein a device size can be reduced, and a recording medium recording a program for the above-mentioned device and method. Other objects, features, advantages and the like of the present invention will become apparent to those skilled in the art, by referring to the following description.

In order to achieve the object, according to an aspect of the present invention, a code conversion method for converting a first code string compliant with a first method into a second code string compliant with a second method, includes a first step of generating a first decoded audio from the first code string in accordance with a first decoding method and a second step of judging whether the first decoded audio is an audio signal or a non-audio signal by using information contained in the first code string, and encoding the first decoded audio in accordance with a second encoding method on the basis of the judgment to generate a second code string.

In the code conversion method of the present invention, preferably, in the second step, whether the first decoded signal is the audio signal or the non-audio signal is judged by using one of frame type information contained in the first code string and a size of the code string.

According to another aspect of the present invention, a code conversion device for converting a first code string compliant with a first method into a second code string compliant with a second method includes an audio decoding circuit for generating a first decoded audio from the first code string in accordance with a first decoding method, and an audio encoding circuit for judging whether the first decoded audio is an audio signal or a non-audio signal by using information contained in the first code string, and encoding the first decoded audio by a second encoding method based on the judgment to generate a second code string.

In the code conversion device of the present invention, preferably, whether the first decoded signal is the audio signal or the non-audio signal is judged by using one of frame type information contained in the first code string and a size of the code string.

According to yet another aspect of the present invention, a code conversion program for use in operating a computer constituting a code conversion device so as to execute conversion operation of a first code string compliant with a first method into a second code string compliant with a second method, the code conversion program comprising the steps of:

(a) processing of generating a first decoded audio from the first code string by a first decoding method; and (b) processing of judging whether the first decoded audio is an audio signal or a non-audio signal by using information contained in the first code string, and encoding the first decoded audio by the second encoding method based on the judgment to generate a second code string.

In the code conversion program of the present invention, preferably, according to claim 9, whether the first decoded audio is the audio signal or the non-audio signal is judged by using one of frame type information contained in the first code string and a size of the code string.

Furthermore, according to yet another aspect of the present invention, a recording medium records and holds the code conversion program.

BEST MODE FOR CARRYING OUT THE INVENTION

Figure 1:
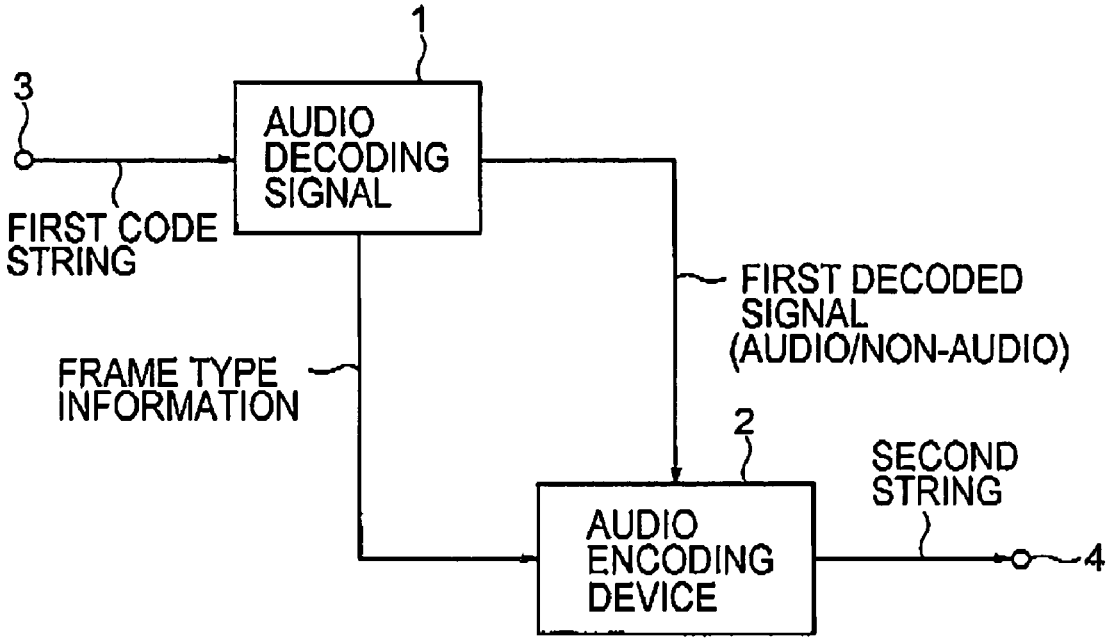
FIG. 1 is a diagram showing a configuration of a code conversion device according to a first embodiment of the present invention.

Hereinafter, the preferred embodiments of the present invention will be described. An outline and a principle of a device and a method of the present invention will be described first, and then the embodiments will be described in detail. FIG. 1 shows a configuration of a code conversion device according to a first embodiment of the present invention. The illustrated code conversion device comprises an audio decoding device 1 and an audio encoding device 2 without an audio detection device 5 shown in FIG. 5.

A first code string encoded in compliance with a first method, i.e., according to the first method, is supplied to the audio decoding device 1 via an input terminal 3. The audio decoding device 1 generates a first decoded audio from the first code string by a first decoding method.

The audio encoding device 2 judges whether the first decoded audio is an audio signal or a non-audio signal in response to information contained in the first code string, and encodes the first decoded audio by a second encoding method based on the judgment to generate a second code string.

The method of the present invention includes the following steps.

Step a: a first decoded audio is generated from a first code string by a first decoding method.

Step b: whether the first decoded audio is an audio signal or a non-audio signal is judged by using information contained in the first code string, and the first decoded audio is encoded by a second encoding method based on the judgment to generate a second code string via an output terminal 4.

Next, operation and merit of the present invention will be described. According to the present invention, by using frame type information contained in the first code string, judgment is made as to whether a signal decoded from the code string corresponds to an audio section or a non-audio section. Thus, an audio detection device is made unnecessary, whereby the code conversion device can be reduced in size.

Figure 5:
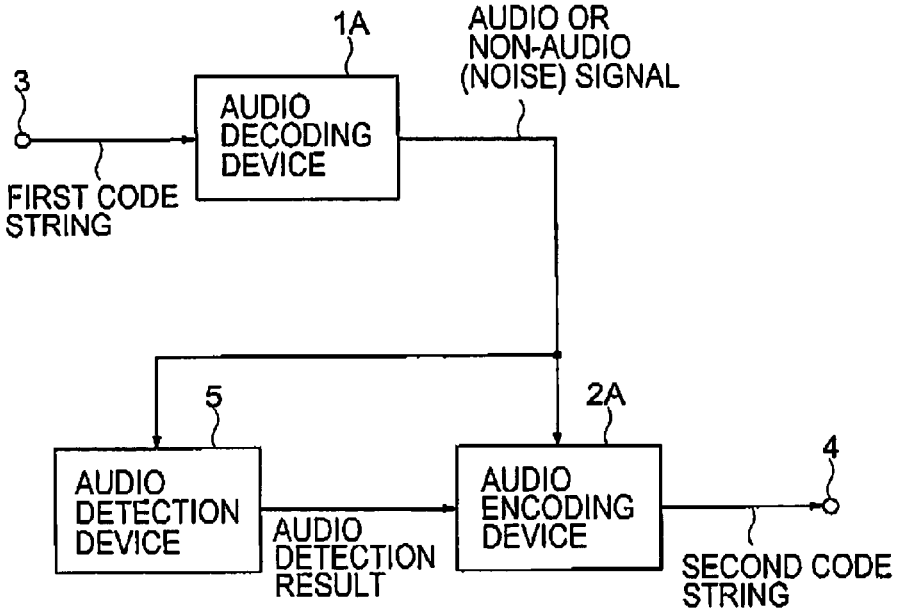
FIG. 5 is a diagram showing a configuration of a conventional code conversion device.

Further, referring to FIG. 1, the code conversion device of the embodiment of the present invention will be described more specifically. The input terminal 3, the output terminal 4, the audio decoding device 1, and the audio encoding device 1 shown in FIG. 1 are basically similar in configuration to those shown in FIG. 5 except that connections are partially different from FIG. 5. A difference from the configuration shown in FIG. 5 is that, in place of judgment as to whether the first decoded signal corresponds to the audio section or the non-audio section at the audio detection device 5, the judgment is carried out by utilizing the frame type information obtained from the first code string. Accordingly, the code conversion device of the present invention can dispense with the audio detection device 5 of FIG. 5.

The audio decoding device 1 receives the first code string via the input terminal 3. Herein, the code string is assumed to be encoded by the first encoding method. The audio decoding device 1 decodes an audio signal or a non-audio signal, such as a noise, by the first decoding method corresponding to the first encoding method, and outputs the decoded signal as a first decoded signal to the audio encoding device 2. Generally, the first code string comprises a header and a payload. The header contains frame type information. It is to be noted that such frame type information makes it possible to judge whether the signal decoded from the code string corresponds to an audio section or a non-audio (no sound or noise) section. The audio decoding device 1 generates an audio signal or a non-audio signal (noise signal) according to this frame type information.

The audio decoding device 1 outputs the frame type information to the audio encoding device 2. In this case, for example, for details on the header and the frame type information, the Patent Document 4 can be referred to.

The payload comprises a code corresponding to a parameter indicating an audio signal (audio parameter) when the frame type information corresponds to the audio section.

On other hand, when the frame type information corresponds to the non-audio section, the payload is often composed of either a code corresponding to a parameter indicating a noise signal (noise parameter) or nothing.

From this fact, it is understood that payload sizes are varied between the audio section and the non-audio section. Thus, using a payload size or a size of the first code string in place of the frame type information also makes it possible to judge whether the signal decoded from the code string corresponds to the audio section or the non-audio section.

The audio encoding device 2 receives the first decoded signal and the frame type information output from the audio decoding device 1. Like in the audio detection result flag mentioned in connection with the configuration shown in FIG. 5, it can be judged on the basis of the frame type information whether the first decoded signal corresponds to the audio section or the non-audio section. The audio encoding device 2 encodes the audio signal or the noise signal by the second encoding method with reference to this frame type information, and outputs a code string thereby obtained as a second code string via the output terminal 4.

In this case, representation corresponding to the audio or the non-audio in the frame type information and representation corresponding to the audio or the non-audio in the audio detection result used in the audio detection device 5 may be correlated with each other beforehand. In such a case, based on this correlation, an audio detection result corresponding to the frame type information output from the audio decoding device 1 is input to the audio encoding device 2. This shows that no modification becomes unnecessary about the audio decoding device 1A and the audio encoding device 2A mentioned in connection with the conventional code conversion device of FIG. 5. In other words, the audio decoding device 1A and the audio encoding device 2A structured in compliance with the standard method may be used without any change.

Figure 2:
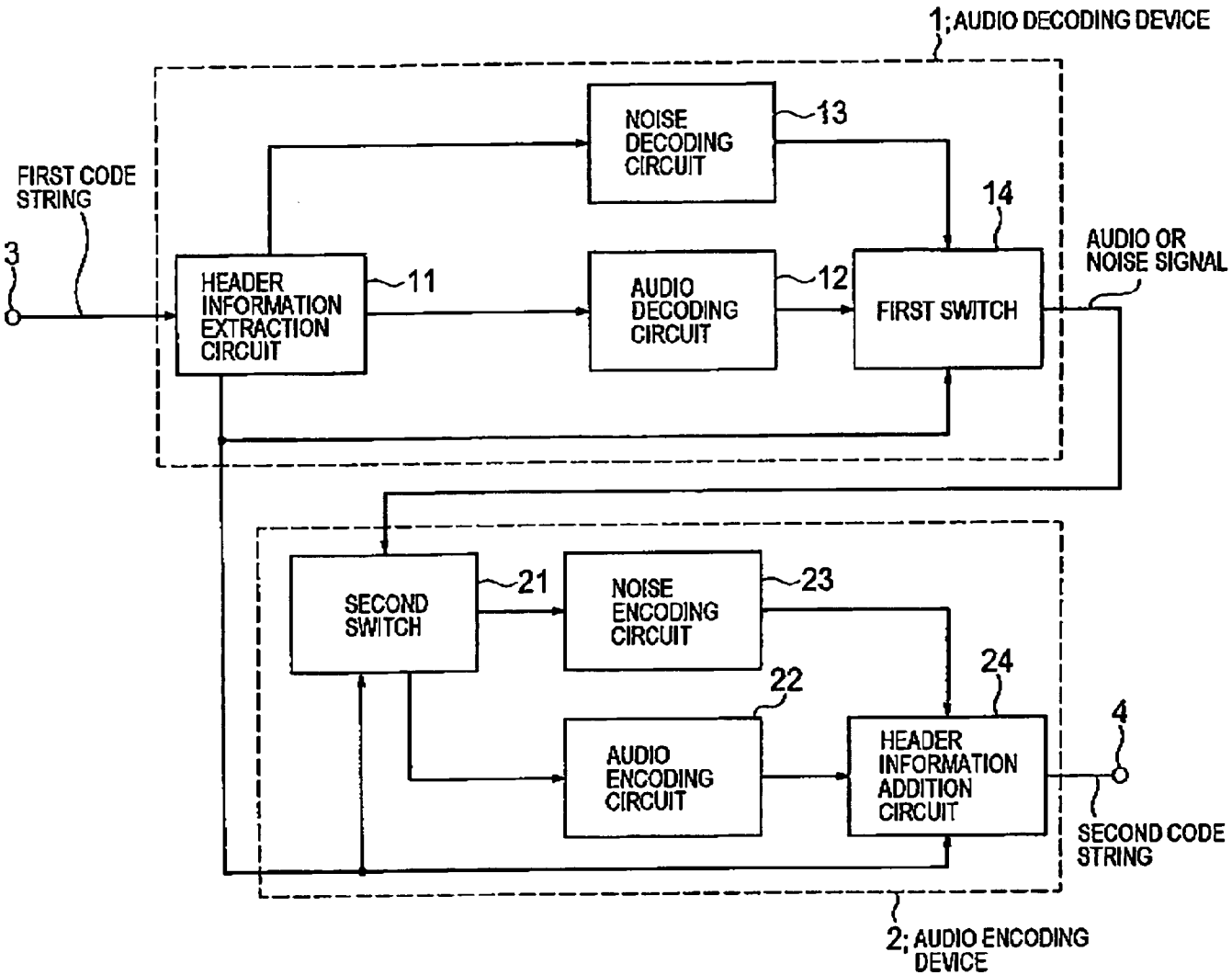
FIG. 2 is a diagram showing in detail the configuration of the code conversion device according to the first embodiment of the present invention.

Next, referring to FIG. 2, the audio decoding device 1 and the audio encoding device 2 constituting the code conversion device of the embodiment will be described in detail. The audio decoding device 1 comprises a header information extraction circuit 11, an audio decoding circuit 12, a noise decoding circuit 13, and a first switch 14.

On the other hand, the audio encoding device 2 comprises a second switch 21, an audio encoding circuit 22, a noise encoding circuit 23, and a header information addition circuit 24.

The header information extraction circuit 11 separates the header and the payload from the first code string input given via the input terminal 3. In this case, the header contains frame type information. When the frame type information corresponds to the audio section, a code corresponding to an audio parameter is output to the audio decoding circuit 12. The audio parameter may include, for example, a linear prediction (LP) coefficient, an adaptive codebook (ACB), a fixed codebook (FCB), an ACB gain, and an FCB gain, all of which may be made to correspond to a first LP coefficient code, a first ACB code, a first FCB code, and a first gain code, respectively.

On the other hand, when the frame type information corresponds to the non-audio section, a code corresponding to a noise parameter is output to the noise decoding circuit 13. The noise parameter may include, for example, an LP coefficient and frame energy, which are may be made to correspond to a first LP coefficient code and a first frame energy code, respectively.

The audio decoding circuit 12 receives the first LP coefficient code, the first ACB code, the first FCB code, and the first gain code output from the header information extraction circuit 11, decodes an audio from the codes by the first decoding method 1, and outputs the decoded audio as a first decoded audio to the first switch 14.

The noise decoding circuit 13 receives the first LP coefficient code and the first frame energy code output from the header information extraction 11, decodes a noise from the codes by the first decoding method 1, and outputs the decoded noise as a first decoded noise to the first switch 14. As regards details on the noise decoding method, for example, Chapter 6 of the Nonpatent Document 5 can be referred to.

The first switch 14 receives the frame type information output from the header information extraction circuit 11 and outputs the first decoded audio sent from the audio decoding circuit 1 (sic) 12 to the second switch 21 when the frame type information corresponds to the audio section, and outputs the first decoded noise sent from the noise decoding circuit 13 to the second switch 21 when the frame type information corresponds to the non-audio section.

The second switch 21 receives the frame type information output from the header information extraction circuit 11, outputs the first decoded audio sent from the first switch 14 to the audio encoding circuit 22 when the frame type information corresponds to the audio section, and outputs the first decoded noise sent from the first switch 14 to the noise encoding circuit 23 when the frame type information corresponds to the non-audio section.

The audio encoding circuit 22 is supplied with the first decoded audio from the second switch 21, and encodes the same in accordance with the second encoding method, into the LP coefficient code, the ACB code, the FCB code and the gain code. Then, these codes are supplied as a second LP coefficient code, a second ACB code, a second FCB code, and a second gain code to the header information addition circuit 24.

The noise encoding circuit 23 is supplied with the first decoded noise from the second switch 21, and encodes the same in accordance with the second encoding method, into an LP coefficient code and a frame energy code. Then, these codes are supplied as a second LP coefficient code and a second frame energy code to the header information addition circuit 24. For details on the noise encoding method, for example, Chapter 5 of the Nonpatent Document 5 can be referred to.

Supplied with the receives the frame type information from the header information extraction circuit 11, the header information addition circuit 24 constitutes the payload by the second LP coefficient code, the second ACB code, the second FCB code, and the second gain code sent from the audio encoding circuit 22 when the frame type information corresponds to the audio section, and outputs a second code string obtained by adding a header to the payload via the output terminal 4. On the other hand, when the frame type information corresponds to the non-audio section, the second LP coefficient code and the second frame energy code output from the noise encoding circuit 23 are constituted as a payload, and a second code string obtained by adding a header to this payload is output via the output terminal 4. For details on the header and the frame type information, for example, the Nonpatent Document 4 or the like can be referred to. The first embodiment has been described.

Figure 3:
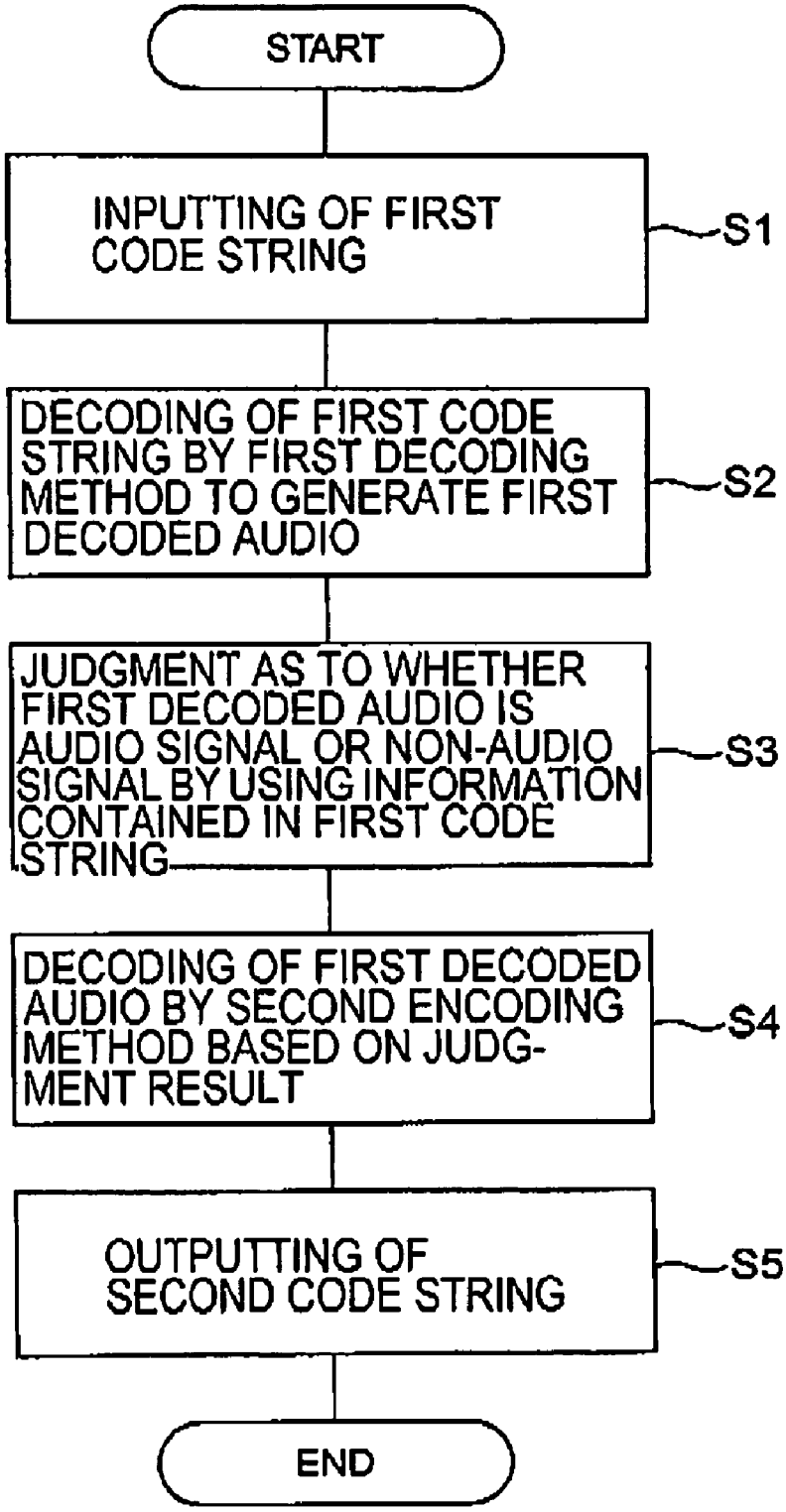
FIG. 3 is a flowchart showing a process of the code conversion device according to the first embodiment of the present invention.

FIG. 3 is a flowchart illustrating a code conversion method according to an embodiment of the present invention. Referring to FIG. 3, and FIG. 1 or 2, it can be understood that the method of the embodiment of the present invention comprises the following steps.

The audio decoding device 1 receives the first code string from the input terminal 3 (step S1).

The audio decoding device 1 generates the first decoded audio in response to the first input code string in accordance with the first decoding method (step S2).

More specifically, in the audio decoding device 1, a header containing frame type information and a payload are separated from the first code string input from the input terminal 3, an audio of a code corresponding to an audio parameter is decoded into a decoded audio in accordance with the first decoding method corresponding to the first encoding method when the frame type information corresponds to an audio section. The decoded audio is output as the first decoded audio. On the other hand, when the frame type information corresponds to a non-audio section, a noise corresponding to a noise parameter is decoded into the first decoded noise in accordance with the decoding method corresponding to the first encoding method and the first decoded noise is output from the noise decoding circuit 13. Accordingly, the audio decoding device 1 is switched and controlled by the first switch 14 to output the first decoded audio on the basis of the fame type information when the frame type information corresponds to the audio section, and to output the first decoded noise when the frame type information corresponds to the non-audio section.

On the other hand, the audio encoding device 2 judges whether the first decoded audio is an audio signal or a non-audio signal by using information contained in the code string (step S3).

The shown audio encoding device 2 receives the frame type information from the header information extraction circuit 11 of the audio decoding device 1, and judges whether the first decoded audio corresponds to the audio section or the non-audio section based on the frame type information.

The audio encoding device 2 encodes the first decoded audio by the second encoding method on the basis of a result of the judgment to generate a second code string (step S4).

When the frame type information corresponds to the audio section, the first decoded audio is encoded in accordance with the second encoding method at the audio encoding circuit 22 to be output as a second code string. On the other hand, when the frame type information corresponds to the non-audio section, the first decoded noise is encoded in accordance with the second encoding method at the noise encoding circuit 23 to be output as a second code string via the output terminal 4 (step S5).

More specifically, in the header information addition circuit 24, based on the frame type information, when the frame type information corresponds to the audio section, the second code obtained by encoding the first decoded audio from the audio decoding device 1 by the second encoding method is set as a payload, and a second code string obtained by adding a header to the payload is output from the output terminal. When the frame type information corresponds to the non-audio section, the second code obtained by encoding the first decoded noise from the audio decoding device 1 by the second encoding method is set as a payload, and a second code string obtained by adding a header to the payload is output from the output terminal 4.

Figure 4:
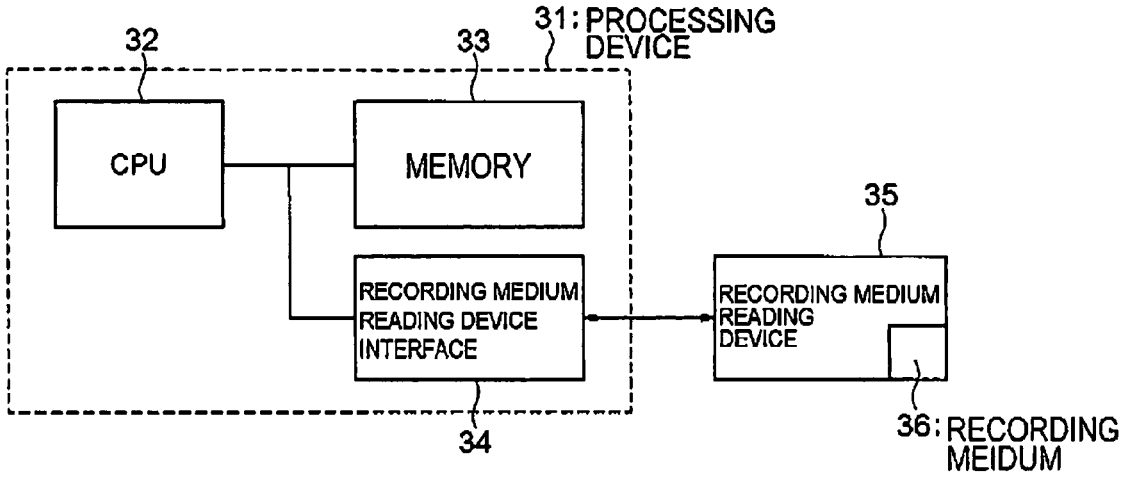
FIG. 4 is a diagram showing a configuration of a code conversion device according to a second embodiment of the present invention.

The code conversion device of the embodiment of the present invention may be realized by computer control (program control method) such as a digital signal processor. FIG. 4 schematically shows a device configuration when the code conversion processing of the aforementioned embodiment is realized by a processor (computer) such as a digital signal processor according to a second embodiment of the present invention. In a computer 31 for executing a program read from a recording medium 36, when code conversion processing is executed to convert a first code string obtained by encoding an audio by a first encoding/decoding device into a second code string decodable by a second encoding/decoding device, a program is stored in the recording medium 36 and is for executing the following steps:

(a) processing of generating a first decoded audio from the first code string in accordance with the first decoding method; and (b) processing of judging whether the first decoded signal is an audio signal or a non-audio signal by using information contained in the first code string, and encoding the first decoded audio in accordance with the second encoding method on the basis of the judgment to generate a second code string.

A CPU 32 reads the program out of the recording medium 36 through a recording medium reading device 35 and a recording medium reading device interface 34. The program is stored in a memory 33 to be executed. The program may be stored in a mask ROM or a nonvolatile memory, such as a flash memory. The recording medium includes a nonvolatile memory, a medium such as a CD-ROM, an FD, a digital versatile disk (DVD), a magnetic tape (MT), or a portable HDD, or the like.

The present invention has thus far been described in conjunction with the above-mentioned embodiments. However, the invention is not limited to the configurations of the embodiments. Needless to say, those skilled in the art may make various changes and corrections within a scope of the principle of the present invention. For example, the invention can be applied not only to the case where the first and second encoding methods are different from each other but also to the case where the first and second encoding methods are identical to each other to provide the same effects. Moreover, when distinction is made about whether the first code string is the audio signal or the non-audio signal, distinction may be made by using both of the frame type information and the first code string.

INDUSTRIAL APPLICABILITY

As described above, the present invention provides an effect that the size of the code conversion device can be reduced. According to the invention, its reason is that by using the frame type information contained in the first code string, the judgment is made as to whether the signal decoded from the code string is in the audio section or the non-audio section, which dispenses with the audio detection device.

The invention claimed is:

1. A code conversion method of receiving a first code string to convert the first code string into a second code string, and to output the same, the method comprising:

generating a decoded signal from the first code string in accordance with a decoding method; and judging whether the decoded signal is an audio signal or a non-audio signal by using information contained in the undecoded first code string, and encoding the decoded signal in accordance with an encoding method on the basis of the judgment to generate a second code string, wherein the generating step includes an audio decoding step and a non-audio decoding step;

the audio decoding step comprises receiving a first code corresponding to an audio parameter contained in the first code string when the information corresponds to an audio section, and decoding an audio signal from the first code by the decoding method, and outputting the decoded audio signal as the decoded signal; and the non-audio decoding step comprises receiving a second code corresponding to a non-audio parameter contained in the first code when the information corresponds to a non-audio section, decoding a non-audio signal from the first code by the decoding method, and outputting the decoded non-audio signal as the decoded signal.

2. A code conversion device for receiving a first code string compliant with a first encoding method to convert the first code string into a second code string compliant with a second encoding method, and to output the same, comprising:

an audio decoding device for generating a decoded signal from the first code string in accordance with a decoding method; and an audio encoding device for judging whether the decoded signal is an audio signal or a non-audio signal using information contained in the undecoded first code string, and encoding the decoded signal in accordance with the encoding method on the basis of the judgment to generate the second code string, wherein the audio decoding device includes an audio decoding circuit and a non-audio decoding circuit;

the audio decoding circuit receives a first code corresponding to an audio parameter contained in the first code string when the information corresponds to an audio section, and decodes an audio signal from the first code by the decoding method, and outputs the decoded audio signal as the decoded signal; and the non-audio decoding circuit receives a second code corresponding to a non-audio parameter contained in the first code when the information corresponds to a non-audio section, decodes a non-audio signal from the first code by the decoding method, and outputs the decoded non-audio signal as the decoded signal.

3. A computer readable storage medium storing a code conversion program for use in operating a program controlled processor device that constitutes a code conversion device responsive to a first code string so as to convert the first code string into a second code string, the program making the program-controlled processor device execute the steps of:

(a) generating a first decoded audio signal from the first code string by a decoding method; and (b) judging whether the decoded signal is an audio signal or a non-audio signal by using information contained in the undecoded first code string, and encoding the decoded signal by the encoding method based on the judgment to generate a second code string, wherein the generating step includes an audio decoding step and a non-audio decoding step;

the audio decoding step comprises receiving a first code corresponding to an audio parameter contained in the first code string when the information corresponds to an audio section, and decoding an audio signal from the first code by the decoding method, and outputting the decoded audio signal as the decoded signal; and the non-audio decoding step comprises receiving a second code corresponding to a non-audio parameter contained in the first code when the information corresponds to a non-audio section, decoding a non-audio signal from the first code by the decoding method, and outputting the decoded non-audio signal as the decoded signal.

4. The code conversion method according to claim 1, wherein the first code string and the second code string are encoded by encoding methods different from each other.

5. The code conversion method according to claim 1, wherein the first code string and the second code string are encoded by the same encoding method.

6. The code conversion device according to claim 2, wherein the first encoding method is different from the second encoding method.

7. The code conversion device according to claim 2, wherein the first encoding method is the same as the second encoding method.

8. The computer readable storage medium according to claim 3, wherein the first code string and the second code string are encoded by encoding methods different from each other.

9. The computer storage readable medium according to claim 3, wherein the first code string and the second code string are encoded by the same encoding method.

10. A code conversion method of receiving a first code string to convert the first code string into a second code string, and to output the same, the method comprising;

judging whether the first code string corresponds to an audio section or a non-audio section by using information contained in an undecoded first code string;

generating a decoded signal from the first code string in accordance with a decoding method on the basis of the judgment; and encoding the decoded signal in accordance with an encoding method to generate the second code string;

wherein the encoding step includes an audio encoding step and a non-audio encoding step;

the audio encoding step comprises receiving an audio signal generated from the first code string when the information corresponds to the audio section;

encoding the audio signal by the encoding method, and outputting the encoded audio signal as the second code string; and the non-audio encoding step comprises receiving a non-audio signal generated from the first code string when the information corresponds to the non-audio section, encoding the non-audio signal by the encoding method, and outputting the encoded non-audio signal as the second code string.

11. A code conversion device for receiving a first code string compliant with a first encoding method to convert the first code string into a second code string compliant with a second encoding method and to output the same, the code conversion device comprising:

a judging device for judging whether the first code string corresponds to an audio section or a non-audio section by using information contained in an undecoded first code string;

a generating device for generating a decoded signal from the first code string in accordance with a decoding method on the basis of the judgment;

an encoding device for encoding the decoded signal in accordance with an encoding method to generate the second code string;

wherein the encoding device includes an audio encoding device and a non-audio encoding device;

the audio encoding device comprises:

a receiving device for receiving an audio signal generated from the first code string when the information corresponds to the audio section;

an encoding device for encoding the audio signal by the encoding method, and outputting the encoded audio signal as the second code string; and the non-audio encoding device comprises:

a receiving device for receiving a non-audio signal generated from the first code string when the information corresponds to the non-audio section and an encoding device for encoding the non-audio signal by the encoding method, and outputting the encoded non-audio signal as the second code string.

12. A computer readable storage medium storing a code conversion program for use in operating a program controlled processor device that constitutes a code conversion device responsive to a first code string so as to convert the first code string into a second code string, the program making the program controlled processor execute the steps of:

judging whether the first code string corresponds to an audio section or a non-audio section by using information contained in an undecoded first code string;

generating a decoded signal from the first code string in accordance with a decoding method on the basis of the judgment; and encoding the decoded signal in accordance with an encoding method to generate the second code string;

wherein the encoding step includes an audio encoding step and a non-audio encoding step;

the audio encoding step comprises receiving an audio signal generated from the first code string when the information corresponds to the audio section;

encoding the audio signal by the encoding method, and outputting the encoded audio signal as the second code string; and the non-audio encoding step comprises receiving a non-audio signal generated from the first code string when the information corresponds to the non-audio section, encoding the non-audio signal by the encoding method, and outputting the encoded non-audio signal as the second code string.

* * * * *